US005294176A

United States Patent [19]

Asinovsky

[11] Patent Number: 5,294,176

[45] Date of Patent: Mar. 15, 1994

[54] SEXUAL DEVICE FOR HANDICAPPED MEN

[76] Inventor: Ruven Asinovsky, 8/60 Habikurim Street, 28 000 Kiryat Ata, Israel

[21] Appl. No.: 863,885

[22] Filed: Apr. 6, 1992

[51] Int. Cl.[5] ..... A47C 1/00

[52] U.S. Cl. ..... 297/245; 297/258; 297/344.21; 297/344.18; 5/929; 128/845

[58] Field of Search ..... 297/245, 258, 278, 345, 297/349; 5/929, 604, 652; 128/30, 33, 845; 600/38-41

[56] References Cited

U.S. PATENT DOCUMENTS

| | | | |
|---|---|---|---|
| 2,528,950 | 11/1950 | Engstrom | 297/349 X |
| 2,797,738 | 7/1957 | Patterson | 297/345 |
| 3,668,722 | 6/1972 | Gallant | 5/929 X |
| 3,711,152 | 1/1973 | Sirpak et al. | 297/345 X |
| 3,789,444 | 2/1974 | McCord | 297/349 X |
| 3,971,592 | 7/1976 | Farley | 5/929 X |
| 4,825,855 | 5/1989 | Kundson, Jr. | 5/929 X |
| 4,974,904 | 12/1990 | Phillips et al. | 297/258 |
| 5,178,438 | 1/1993 | Beger | 297/258 |

*Primary Examiner*—Peter M. Cuomo
*Assistant Examiner*—Suzanne L. Dino
*Attorney, Agent, or Firm*—Mark M. Friedman

[57] ABSTRACT

A device for facilitating sexual intercourse of a man having limited mobility of the lower part of the trunk, which includes a support under which the lower part of the man's trunk can fit and a seating platform resting on the support and capable of rotation relative to the support. The seating platform is annular in shape and is oriented substantially horizontally. The seating platform can accommodated a seated woman who can thereby have sexual intercourse with the man without the man bearing the weight of the woman and without his having to exert motions of the lower part of his trunk.

11 Claims, 1 Drawing Sheet

SEXUAL DEVICE FOR HANDICAPPED MEN

FIELD AND BACKGROUND OF THE INVENTION

The present invention relates to the field of mechanical devices for use in facilitating sexual intercourse and, more particularly, to a mechanical device which can facilitate sexual intercourse by men with limited power of motion in the lower part of the trunk.

The performance of the sexual act requires of the man a certain amount of strength and mobility of the lower part of the trunk. Unfortunately, a significant fraction of men suffer from a lack of the requisite degree of strength and mobility of the lower part of the trunk, either permanently or temporarily, which makes it difficult or even impossible to perform the sexual act. Such loss of strength and mobility could come about as a result of disease or an accident, including lower back pain, and may last for only a few hours or may be a permanent and incurable condition.

The inability of such handicapped men to perform the sexual act in the conventional manner could be a significant psychological problem and could result, in the developing of lower self-esteem, inferiority complexes, and the like. Since such men are unable to produce strong movements of the lower part of their trunk during the sexual act they become passive and are fully dependent on the activity of the woman during the sexual act.

Several solutions to this problem are available. One of the simplest is the abandonment of the traditional, or missionary, position during intercourse in favor of a position wherein the man lies supine with the woman lying on top of the man. This allows the woman to take the more active role and greatly reduces the activity required of the man.

However, this technique suffers from the drawback that the man, while relieved from the need to exert great strength with the lower part of his trunk, is required to bear the full weight of the woman on the lower part of his trunk, which, in many cases, he may not be able to do, for reasons which are usually related to the same injury or disease which render it difficult or impossible for him to exert motion of the lower part of his trunk.

There is thus a widely recognized need for, and it would be desirable to have, a device which would make it possible for a man suffering from the inability to freely and powerfully move the lower part of his trunk to have satisfying sexual intercourse with his partner, which device would allow the man to take an active role in the sexual act without requiring powerful movements of the lower portion of his trunk and without placing undue weight on the lower portion of his trunk.

SUMMARY OF THE INVENTION

According to the present invention there is provided a device for facilitating sexual intercourse of a man having limited mobility of the lower part of the trunk, comprising: a support characterized in that the support is capable of accommodating under the support the lower part of the trunk of the man; and a seating platform resting on the support, the seating platform being annular in shape and having a substantially horizontal orientation, the seating platform being capable of accommodating a seated sexual partner of the man.

According to further features in preferred embodiments of the invention described below, the seating platform can feature a backrest and/or one or more footrests for use by the woman and preferably includes one or more handles to facilitate rotation and other movement of the platform by the man.

According to still further features in the described preferred embodiments the support can include legs, preferably adjustable in height, whose lower portions are curvilinear to make it possible for the support and thus the seating platform to rock back and forth under force exerted by the arms of the man.

The present invention successfully addresses the shortcomings of the presently known configurations by providing a device which makes it possible for a man with limited or no ability to move the lower part of his trunk to actively carry out the sexual act without having to support the weight of the woman.

The present invention discloses a novel device made up of two basic components—a support and a seating platform. In operation the man lies supine under the support while his sexual partner is seated on the seating platform. Sexual intercourse is carried out in this position with the man able to use his hands to rotate the seating platform and thus his partner in the horizontal plane and also to apply force with his hands to the support so as to force the support and thus the seating platform and his partner to rock back and forth.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a device which can be used to facilitate sexual intercourse on the part of men with limited or no ability to use the lower portion of their trunk.

Devices according to the present invention combine the principles of a rocking chair and of a swivel chair in a unique and novel application which is of great importance for men who are handicapped in not having full mobility of the lower portions of their trunks. The combination of rocking and swiveling motions in a single apparatus makes it possible for the man, using his arms, to cause his partner to move rotationally and/or back-and-forth. In an alternative embodiment, the force necessary to rotate and/or rock the device can be supplied by a mechanical device rather than by the man's arms. This is desirable, for example, where the man is also incapable of exerting sufficient force with his arms to properly activate the device.

Devices according to the present invention put the man largely in control of his sexual act and makes him feel more independent than heretofore possible, with great psychological benefits.

The principles and operation of a device according to the present invention can be better understood with reference to the figures which are illustrative of devices according to the present invention.

Figure 2:
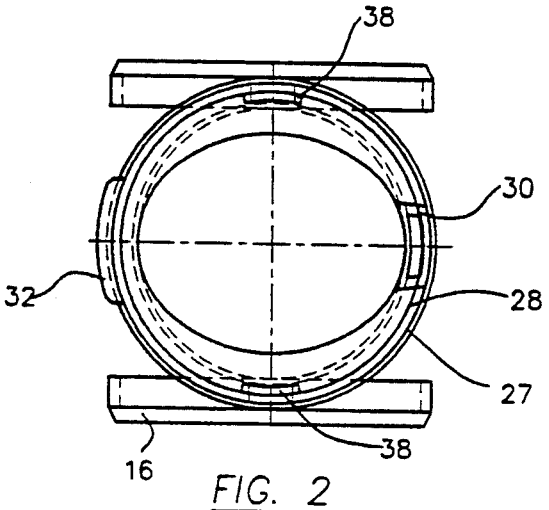
FIG. 2 is a top view of the device of FIG. 1.
Figure 3:
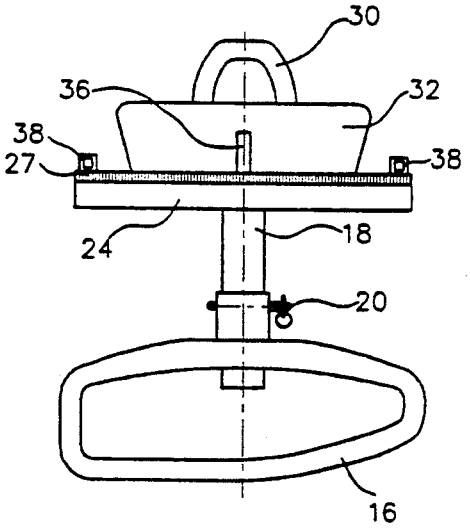
FIG. 3 is another side view of the device of FIGS. 1 and 2.
Figure 1:
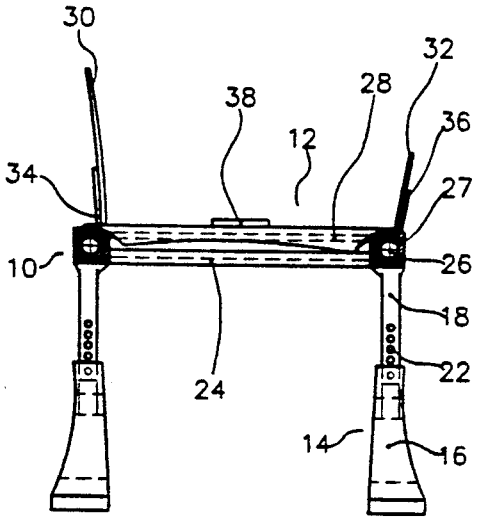
FIG. 1 is a side view of a device according to the present invention.

Referring now to the drawings, FIGS. 1-3 shows three views of an illustrative device according to the present invention.

The illustrated device includes two major parts—a support member, designate generally as 10, and a seating platform, designated generally as 12.

Support member 10 is made up of a pair of substantially vertical legs 14. Legs 14 are sufficiently separated from each other to allow a man (not shown) to lie supine between legs 14 with the lower portion of the man's trunk situated closest to legs 14.

Legs 14 are of a height which will ensure proper penetration of the female sexual organ by the male sexual organ during intercourse. Preferably, the height of legs 14 is adjustable so as to best accommodate a range of physiological characteristics. This may be accomplished by any one of a number of suitable ways.

As an example, and without in any way limiting the scope of the present invention, legs 14 illustrated in FIGS. 1-3 are made up of a lower member 16 and an upper member 18 which are connected to each other through a pin 20 and socket 22 arrangement which makes it possible for the user to choose the socket 22 which will give the device the desired height.

In operation, the lowest portion of lower member 16 is in contact with a surface such as the floor or a bed. The lowest portion of lower member 16 of legs 14 can be of any convenient shape. Preferably, lowest portion of lower member 16 of legs 14 is at least partly curvilinear. This makes it possible for the entire device to be rocked back and forth during use through the exertion of lateral force, as will be described later.

Legs 14 are connected to each other through a substantially horizontal cross member 24 which links legs 14 at or near their uppermost portions. Cross member 24 serves to keep legs 14 properly oriented and, in addition, serves to support seating platform 12 and the sexual partner (not shown) who will be seated on seating platform 12 during use. Cross member 24 is preferably annular in shape, featuring an opening its mid-section.

Support of seating platform 12 can be accomplished in one of several suitable ways. These include a roller or caster system as illustrated in FIG. 1 where the upper surface of cross member 24 features a groove 26 near its periphery. Groove 26 can accommodate balls, casters, rollers, and the like, which can support seating platform 12 and facilitate its smooth rotation relative to support member 10.

An upwardly extending edge 27 is preferably included immediately exterior to groove 26 and runs along the entire periphery. Edge 27 serves to confine seating platform 12 to the proper position and to prevent it from sliding off support 10.

Seating platform 12 features an annular member 28 which features means on its lower surface for engaging the balls, casters, rollers and the like, so as to be supported by support 10 and so as to be rotatable with respect to it. The top surface of annular member 28 is shaped so as to allow the comfortable seating of the woman. In this regard, it may desirable to pad the top surface of annular member 28 with a soft material such as soft plastic or leather in order to make the seating more comfortable for the woman.

Preferably, seating platform 12 also features a backrest 30 attached to the upper surface of annular member 28 which supports the woman's back during use.

Preferably, seating platform 12 further features a footrest 32 attached to the upper surface of annular member 28 at a point substantially opposite backrest 30 which serves to support the woman's feet during use.

Seating platform 12 also preferably features a number of handles to facilitate the manipulation of the device by the man during use. One such handle 34 is preferably located on the outwardly facing surface of backrest 30. Another such handle 36 is preferably located on the outwardly facing surface of footrest 32. Additional handles 38 may be located at convenient points on the top surface of annular member 28.

To use a device according to the present invention, one would proceed as follows. The man lies supine on a surface, such as a bed or the floor. He places the device across the lower portion of his trunk, centered roughly above his sexual organ, with legs 14 straddling the lower portion of his trunk, and supported at their lower extremities on the bed or floor. Legs 14 will have been adjusted to the proper height so as to maximize the effectiveness of the device.

The woman is seated on seating platform 12 with her back supported by backrest 30 and her feet supported by footrest 32. The man inserts his sexual organ into that of his partner and then proceeds to move the device so as to maximize the satisfaction of the partners.

Two types of motion are possible. The motions could be used separately or simultaneously. The force necessary create the motion may be supplied by a motor or other mechanical device (not shown). Preferably, if the man is able, the force is supplied by the man's arms.

One type of motion is rotational motion in a horizontal plane. This is achieved by pushing and/or pulling on handles 34, 36, and/or 38 in such a way as to cause seating platform 12 to rotate about a vertical axis at any desired angular rate and frequency.

The second type of available motion is a rocking back and forth motion about the base of legs 14. This is again achieved by pushing and/or pulling on handles 34, 36, and/or 38 in such a way as to cause seating platform 12 to rock back and forth about the base of legs 14 to any desired extent and at any desired frequency.

It can be seen that the use of a device according to the present invention is highly beneficial for men with limited power of motion in the lower part of the trunk, and their sexual partners. The device may also be of interest to men who do not suffer from such a handicap.

While the invention has been described with respect to one preferred embodiment, it will be appreciated that many variations, modifications and other applications of the invention may be made.

What is claimed is:

1. A device for facilitating sexual intercourse of a man having limited mobility of the lower part of the trunk, comprising:

(a) a support characterized in that said support is capable of accommodating under said support the lower part of the trunk of the man, and further characterized in that the lower portion of said support is curvilinear so as to enable said support to rock; and (b) a seating platform resting on said support, said seating platform being rotatable in the horizontal plane with respect to said support, said seating platform being annular in shape and having a substantially horizontal orientation, said seating platform being capable of accommodating a seated sexual partner of the man.

2. A device as in claim 1 wherein said support includes means for adjusting the height of said support.

3. A device as in claim 1 wherein said seating platform includes a backrest.

4. A device as in claim 1 wherein said seating platform includes a footrest.

5. A device as in claim 3 wherein said seating platform includes a footrest.

6. A device as in claim 1 wherein said seating platform includes a handle.

7. A device as in claim 3 wherein said seating platform includes a handle.

8. A device as in claim 4 wherein said seating platform includes a handle.

9. A device as in claim 1 wherein said support includes casters for making said seating platform rotatable with respect to said support.

10. A device as in claim 1 wherein said support includes rollers for making said seating platform rotatable with respect to said support.

11. A device as in claim 1 wherein said support includes balls for making said seating platform rotatable with respect to said support.

* * * * *